US011965507B1

(12) United States Patent
Broek et al.

(10) Patent No.: US 11,965,507 B1
(45) Date of Patent: Apr. 23, 2024

(54) COMPRESSOR AND VALVE ASSEMBLY

(71) Applicant: Copeland LP, Sidney, OH (US)

(72) Inventors: Titus Broek, Sidney, OH (US); Christian Mora, Dulce Nombre (CR); Jason P. Lochner, Union, OH (US); Aditya Sakhalkar, Sidney, OH (US); Ramesh Chandra Behera, Pune (IN)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/115,355

(22) Filed: Feb. 28, 2023

(30) Foreign Application Priority Data

Dec. 15, 2022 (IN) ..... 202221072622

(51) Int. Cl.

| | |
|---|---|
| ***F04C 18/02*** | (2006.01) |
| ***F04C 2/02*** | (2006.01) |
| ***F04C 28/16*** | (2006.01) |
| ***F04C 29/12*** | (2006.01) |

(52) U.S. Cl.
CPC ..... *F04C 2/02* (2013.01); *F04C 18/0253* (2013.01); *F04C 18/0261* (2013.01); *F04C 28/16* (2013.01); *F04C 29/126* (2013.01); *F04C 29/128* (2013.01)

(58) Field of Classification Search
CPC ..... F04C 29/128; F04C 29/126; F04C 28/16; F04C 18/0261; F04C 18/0253
See application file for complete search history.

(56) References Cited

U.S. PATENT DOCUMENTS

| | | | |
|---|---|---|---|
| 3,303,988 | A | 2/1967 | Weatherhead |
| 3,777,508 | A | 12/1973 | Imabayashi et al. |
| 4,058,988 | A | 11/1977 | Shaw |
| 4,216,661 | A | 8/1980 | Tojo et al. |
| 4,313,314 | A | 2/1982 | Boyanich |

(Continued)

FOREIGN PATENT DOCUMENTS

| | | | |
|---|---|---|---|
| AU | 2002301023 | B2 | 6/2005 |
| CN | 1137614 | A | 12/1996 |

(Continued)

OTHER PUBLICATIONS

International Search Report Regarding Application PCT/US2023/015116-WO-POA dated Sep. 5, 2023.

(Continued)

*Primary Examiner* — Deming Wan
(74) *Attorney, Agent, or Firm* — Harness, Dickey & Pierce, P.L.C.

(57) ABSTRACT

A compressor may include a scroll and a discharge valve assembly. The scroll may include an end plate and a spiral wrap extending from the end plate. The end plate may include a discharge passage. The discharge valve assembly may be mounted to the scroll and may be configured to control fluid flow through the discharge passage within the discharge passage. The discharge valve assembly may include a base and a valve member. The base may be fixed relative to the end and may include a discharge opening in communication with the discharge passage. The valve member may be mounted to the base. The valve member may be deflectable relative to the base between a closed position and an open position. The discharge opening may include at least one radially extending lobe.

17 Claims, 8 Drawing Sheets

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.
6,478,550 B2 11/2002 Matsuba et al.

(56) References Cited

U.S. PATENT DOCUMENTS

| | | | |
|---|---|---|---|
| 6,506,036 | B2 | 1/2003 | Tsubai et al. |
| 6,514,060 | B1 | 2/2003 | Ishiguro et al. |
| 6,537,043 | B1 | 3/2003 | Chen |
| 6,544,016 | B2 | 4/2003 | Gennami et al. |
| 6,558,143 | B2 | 5/2003 | Nakajima et al. |
| 6,589,035 | B1 | 7/2003 | Tsubono et al. |
| 6,619,062 | B1 | 9/2003 | Shibamoto et al. |
| 6,679,683 | B2 | 1/2004 | Seibel et al. |
| 6,705,848 | B2 | 3/2004 | Scancarello |
| 6,715,999 | B2 | 4/2004 | Ancel et al. |
| 6,746,223 | B2 | 6/2004 | Manole |
| 6,769,881 | B2 | 8/2004 | Lee |
| 6,769,888 | B2 | 8/2004 | Tsubono et al. |
| 6,773,242 | B1 | 8/2004 | Perevozchikov |
| 6,817,847 | B2 | 11/2004 | Agner |
| 6,821,092 | B1 | 11/2004 | Gehret et al. |
| 6,863,510 | B2 | 3/2005 | Cho |
| 6,881,046 | B2 | 4/2005 | Shibamoto et al. |
| 6,884,042 | B2 | 4/2005 | Zili et al. |
| 6,887,051 | B2 | 5/2005 | Sakuda et al. |
| 6,893,229 | B2 | 5/2005 | Choi et al. |
| 6,896,493 | B2 | 5/2005 | Chang et al. |
| 6,896,498 | B1 | 5/2005 | Patel |
| 6,913,448 | B2 | 7/2005 | Liang et al. |
| 6,984,114 | B2 | 1/2006 | Zili et al. |
| 7,018,180 | B2 | 3/2006 | Koo |
| 7,029,251 | B2 | 4/2006 | Chang et al. |
| 7,112,046 | B2 | 9/2006 | Kammhoff et al. |
| 7,118,358 | B2 | 10/2006 | Tsubono et al. |
| 7,137,796 | B2 | 11/2006 | Tsubono et al. |
| 7,160,088 | B2 | 1/2007 | Peyton |
| 7,172,395 | B2 | 2/2007 | Shibamoto et al. |
| 7,197,890 | B2 | 4/2007 | Taras et al. |
| 7,207,787 | B2 | 4/2007 | Liang et al. |
| 7,228,710 | B2 | 6/2007 | Lifson |
| 7,229,261 | B2 | 6/2007 | Morimoto et al. |
| 7,255,542 | B2 | 8/2007 | Lifson et al. |
| 7,261,527 | B2 | 8/2007 | Alexander et al. |
| 7,311,740 | B2 | 12/2007 | Williams et al. |
| 7,344,365 | B2 | 3/2008 | Takeuchi et al. |
| RE40,257 | E | 4/2008 | Doepker et al. |
| 7,354,259 | B2 | 4/2008 | Tsubono et al. |
| 7,364,416 | B2 | 4/2008 | Liang et al. |
| 7,371,057 | B2 | 5/2008 | Shin et al. |
| 7,371,059 | B2 | 5/2008 | Ignatiev et al. |
| RE40,399 | E | 6/2008 | Hugenroth et al. |
| RE40,400 | E | 6/2008 | Bass et al. |
| 7,393,190 | B2 | 7/2008 | Lee et al. |
| 7,404,706 | B2 | 7/2008 | Ishikawa et al. |
| 7,429,167 | B2 | 9/2008 | Bonear et al. |
| RE40,554 | E | 10/2008 | Bass et al. |
| 7,484,374 | B2 | 2/2009 | Pham et al. |
| 7,510,382 | B2 | 3/2009 | Jeong |
| 7,547,202 | B2 | 6/2009 | Knapke |
| 7,641,455 | B2 | 1/2010 | Fujiwara et al. |
| 7,674,098 | B2 | 3/2010 | Lifson |
| 7,695,257 | B2 | 4/2010 | Joo et al. |
| 7,717,687 | B2 | 5/2010 | Reinhart |
| 7,771,178 | B2 | 8/2010 | Perevozchikov et al. |
| 7,802,972 | B2 | 9/2010 | Shimizu et al. |
| 7,815,423 | B2 | 10/2010 | Guo et al. |
| 7,827,809 | B2 | 11/2010 | Pham et al. |
| 7,891,961 | B2 | 2/2011 | Shimizu et al. |
| 7,896,629 | B2 | 3/2011 | Ignatiev et al. |
| RE42,371 | E | 5/2011 | Peyton |
| 7,956,501 | B2 | 6/2011 | Jun et al. |
| 7,967,582 | B2 | 6/2011 | Akei et al. |
| 7,967,583 | B2 | 6/2011 | Stover et al. |
| 7,972,125 | B2 | 7/2011 | Stover et al. |
| 7,976,289 | B2 | 7/2011 | Masao |
| 7,976,295 | B2 | 7/2011 | Stover et al. |
| 7,988,433 | B2 | 8/2011 | Akei et al. |
| 7,988,434 | B2 | 8/2011 | Stover et al. |
| 8,020,402 | B2 | 9/2011 | Pham et al. |
| 8,025,492 | B2 | 9/2011 | Seibel et al. |
| 8,079,229 | B2 | 12/2011 | Lifson et al. |
| 8,303,278 | B2 | 11/2012 | Roof et al. |
| 8,303,279 | B2 | 11/2012 | Hahn |
| 8,308,448 | B2 | 11/2012 | Fields et al. |
| 8,313,318 | B2 | 11/2012 | Stover et al. |
| 8,328,531 | B2 | 12/2012 | Milliff et al. |
| 8,328,543 | B2 | 12/2012 | Wilson |
| 8,393,882 | B2 | 3/2013 | Ignatiev et al. |
| 8,424,326 | B2 | 4/2013 | Mitra et al. |
| 8,505,331 | B2 | 8/2013 | Pham et al. |
| 8,506,271 | B2 | 8/2013 | Seibel et al. |
| 8,517,703 | B2 | 8/2013 | Doepker |
| 8,585,382 | B2 | 11/2013 | Akei et al. |
| 8,616,014 | B2 | 12/2013 | Stover et al. |
| 8,672,646 | B2 | 3/2014 | Ishizono et al. |
| 8,757,988 | B2 | 6/2014 | Fukudome et al. |
| 8,790,098 | B2 | 7/2014 | Stover et al. |
| 8,840,384 | B2 | 9/2014 | Patel et al. |
| 8,857,200 | B2 | 10/2014 | Stover et al. |
| 8,932,036 | B2 | 1/2015 | Monnier et al. |
| 9,068,765 | B2 | 6/2015 | Huff |
| 9,080,446 | B2 | 7/2015 | Heusler et al. |
| 9,127,677 | B2 | 9/2015 | Doepker |
| 9,145,891 | B2 | 9/2015 | Kim et al. |
| 9,169,839 | B2 | 10/2015 | Ishizono et al. |
| 9,194,395 | B2 | 11/2015 | Ginies et al. |
| 9,217,433 | B2 | 12/2015 | Park et al. |
| 9,228,587 | B2 | 1/2016 | Lee et al. |
| 9,249,802 | B2 | 2/2016 | Doepker et al. |
| 9,297,383 | B2 | 3/2016 | Jin et al. |
| 9,303,642 | B2 | 4/2016 | Akei et al. |
| 9,360,011 | B2 | 6/2016 | Perevozchikov et al. |
| 9,435,340 | B2 | 9/2016 | Doepker et al. |
| 9,494,157 | B2 | 11/2016 | Doepker |
| 9,541,084 | B2 | 1/2017 | Ignatiev et al. |
| 9,556,862 | B2 | 1/2017 | Yoshihiro et al. |
| 9,605,677 | B2 | 3/2017 | Heidecker et al. |
| 9,612,042 | B2 | 4/2017 | Sjoholm et al. |
| 9,624,928 | B2 | 4/2017 | Yamazaki et al. |
| 9,638,191 | B2 | 5/2017 | Stover |
| 9,651,043 | B2 | 5/2017 | Stover et al. |
| 9,777,730 | B2 | 10/2017 | Doepker et al. |
| 9,777,863 | B2 | 10/2017 | Higashidozono et al. |
| 9,790,940 | B2 | 10/2017 | Doepker et al. |
| 9,850,903 | B2 | 12/2017 | Perevozchikov |
| 9,869,315 | B2 | 1/2018 | Jang et al. |
| 9,879,674 | B2 | 1/2018 | Akei et al. |
| 9,885,347 | B2 | 2/2018 | Lachey et al. |
| 9,920,759 | B2 | 3/2018 | Sung et al. |
| 9,926,932 | B2 | 3/2018 | Perevozchikov et al. |
| 9,989,057 | B2 | 6/2018 | Ochner et al. |
| 10,066,622 | B2 | 9/2018 | Pax et al. |
| 10,087,936 | B2 | 10/2018 | Pax et al. |
| 10,088,202 | B2 | 10/2018 | Huff et al. |
| 10,094,380 | B2 | 10/2018 | Doepker et al. |
| 10,428,818 | B2 | 10/2019 | Jin et al. |
| 10,563,891 | B2 | 2/2020 | Smerud et al. |
| 10,724,523 | B2 | 7/2020 | Wu et al. |
| 10,815,999 | B2 | 10/2020 | Jeong |
| 10,907,633 | B2 | 2/2021 | Doepker et al. |
| 10,954,940 | B2 | 3/2021 | Akei et al. |
| 10,974,317 | B2 | 4/2021 | Ruxanda et al. |
| 11,209,000 | B2 | 12/2021 | Moore et al. |
| 11,231,034 | B2 | 1/2022 | Funakoshi et al. |
| 11,300,329 | B2 | 4/2022 | Yan et al. |
| 11,378,290 | B2 | 7/2022 | Locke et al. |
| 11,493,040 | B2 | 11/2022 | Zou et al. |
| 2001/0010800 | A1 | 8/2001 | Kohsokabe et al. |
| 2002/0039540 | A1 | 4/2002 | Kuroki et al. |
| 2002/0057975 | A1 | 5/2002 | Nakajima et al. |
| 2003/0044296 | A1 | 3/2003 | Chen |
| 2003/0044297 | A1 | 3/2003 | Gennami et al. |
| 2003/0186060 | A1 | 10/2003 | Rao |
| 2003/0228235 | A1 | 12/2003 | Sowa et al. |
| 2004/0126259 | A1 | 7/2004 | Choi et al. |
| 2004/0136854 | A1 | 7/2004 | Kimura et al. |
| 2004/0146419 | A1 | 7/2004 | Kawaguchi et al. |
| 2004/0170509 | A1 | 9/2004 | Wehrenberg et al. |
| 2004/0184932 | A1 | 9/2004 | Lifson |

(56) References Cited

U.S. PATENT DOCUMENTS

2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0003666 A1 1/2007 Gutknecht et al.
2007/0036661 A1 2/2007 Stover
2007/0110604 A1 5/2007 Peyton
2007/0130973 A1 6/2007 Lifson et al.
2007/0148026 A1* 6/2007 Higashi ..... F04B 39/1073 417/559
2008/0034772 A1 2/2008 Chumley et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0205345 A1 8/2009 Narayanamurthy et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0052437 A1 3/2011 Iitsuka et al.
2011/0135509 A1 6/2011 Fields et al.
2011/0174014 A1 7/2011 Scarcella et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0067070 A1 3/2012 Albertson
2012/0107163 A1 5/2012 Monnier et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0098071 A1 4/2013 Means
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0275898 A1 10/2015 Ahire et al.
2015/0300353 A1 10/2015 Utpat et al.
2015/0330386 A1 11/2015 Doepker
2015/0345493 A1* 12/2015 Lochner ..... F04C 29/128 418/55.5
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138879 A1 5/2016 Matsukado et al.
2016/0201673 A1* 7/2016 Perevozchikov ..... F04C 28/24 137/527
2016/0208803 A1 7/2016 Uekawa et al.
2016/0272047 A1 9/2016 Gan
2017/0002817 A1 1/2017 Stover
2017/0002818 A1 1/2017 Stover
2017/0030354 A1 2/2017 Stover
2017/0097108 A1 4/2017 Huff
2017/0241417 A1 8/2017 Jin et al.
2017/0268510 A1 9/2017 Stover et al.
2017/0306960 A1 10/2017 Pax et al.
2017/0314558 A1 11/2017 Pax et al.
2017/0342978 A1 11/2017 Doepker
2017/0342983 A1 11/2017 Jin et al.
2017/0342984 A1 11/2017 Jin et al.
2018/0023570 A1 1/2018 Huang et al.
2018/0038369 A1 2/2018 Doepker et al.
2018/0038370 A1 2/2018 Doepker et al.
2018/0066656 A1 3/2018 Perevozchikov et al.
2018/0066657 A1 3/2018 Perevozchikov et al.
2018/0135625 A1 5/2018 Naganuma et al.
2018/0149155 A1 5/2018 Akei et al.
2018/0216618 A1 8/2018 Jeong
2018/0223823 A1 8/2018 Ignatiev et al.
2019/0040861 A1 2/2019 Doepker et al.
2019/0041107 A1 2/2019 Pispopo et al.
2019/0101120 A1 4/2019 Perevozchikov et al.
2019/0162185 A1* 5/2019 Mizushima ..... F04C 18/0261
2019/0186491 A1 6/2019 Perevozchikov et al.
2019/0203709 A1 7/2019 Her et al.
2019/0277288 A1 9/2019 Flanigan et al.
2019/0353164 A1 11/2019 Berning et al.
2020/0057458 A1 2/2020 Taguchi
2020/0291943 A1 9/2020 McBean et al.
2020/0370808 A1 11/2020 Feng et al.
2021/0262470 A1 8/2021 Wei et al.
2022/0065504 A1 3/2022 Zou
2022/0235774 A1 7/2022 Cui et al.

FOREIGN PATENT DOCUMENTS

CN 1158944 A 9/1997
CN 1158945 A 9/1997
CN 1177681 A 4/1998
CN 1177683 A 4/1998
CN 1259625 A 7/2000
CN 1286358 A 3/2001
CN 1289011 A 3/2001
CN 1339087 A 3/2002
CN 1349053 A 5/2002
CN 1382912 A 12/2002
CN 1407233 A 4/2003
CN 1407234 A 4/2003
CN 1517553 A 8/2004
CN 1601106 A 3/2005
CN 1680720 A 10/2005

(56) References Cited

FOREIGN PATENT DOCUMENTS

| | | | |
|---|---|---|---|
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1 241 417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130011864 | A | 1/2013 |
| KR | 20130011864 | A | 1/2013 |
| KR | 20130094646 | A | 8/2013 |
| KR | 20140114212 | A | 9/2014 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | WO-2019128793 | A1 | 7/2019 |
| WO | 2019165254 | A1 | 8/2019 |
| WO | 2019222535 | A1 | 11/2019 |

OTHER PUBLICATIONS

Office Action regarding Indian Patent Application No. 1071/KOL/2007, dated Apr. 27, 2012.

Office Action regarding U.S. Appl. No. 13/036,529, dated Aug. 22, 2012.

International Search Report regarding International Application No. PCT/US2015/042479, dated Oct. 23, 2015.

Written Opinion of the International Searching Authority regarding International Application No. PCT/US2015/042479, dated Oct. 23, 2015.

Restriction Requirement regarding U.S. Appl. No. 14/809,786, dated Aug. 16, 2017.

International Search Report regarding International Application No. PCT/US2017/050525, dated Dec. 28, 2017.

Written Opinion of the International Searching Authority regarding International Application No. PCT/US2017/050525, dated Dec. 28, 2017.

Office Action regarding U.S. Appl. No. 14/809,786, dated Jan. 11, 2018.

Office Action regarding Chinese Patent Application No. 201580041209.5, dated Jan. 17, 2018. Translation provided by Unitalen Attorneys at Law.

Office Action regarding Chinese Patent Application No. 201710795228.8, dated Sep. 5, 2018. Translation provided by Unitalen Attorneys at Law.

(56) References Cited

OTHER PUBLICATIONS

Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by KS KORYO International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.
Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Notice of Allowance regarding U.S. Appl. No. 15/692,844, dated Feb. 20, 2020.
Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by Ks Koryo International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.
Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.

(56) References Cited

OTHER PUBLICATIONS

Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action dated Jan. 19, 2023, in U.S. Appl. No. 17/196,119.
Office Action dated Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
International Search Report and Written Opinion in corresponding Application No. PCT/US2022/033029 dated Dec. 6, 2022.
Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Crompressors" (1994). International Compressor Engineering Conference. Paper 1056.
Toyama, T.; Nishikawa, Y.; Yoshida, Y.; Hiodoshi, S.; and Shibamoto, Y., "Reduction Of Noise And Over-Compression Loss By Scroll Compressor With Modified Discharge Check Valve" (2002). International Compressor Engineering Conference. Paper 1587.
Yanagisawa, M.; Uematsu, T.; Hiodoshi, S.; Saito, M.; and Era, S., "Noise Reduction Technology For Inverter Controlled Scroll Compressors" (2002). International Compressor Engineering Conference. Paper 1578.
International Search Report regarding International Application No. PCT/US2011/025921, dated Oct. 7, 2011.
Written Opinion of the International Search Authority regarding International Application No. PCT/US2011/025921, dated Oct. 7, 2011.
Written Opinion of the International Searching Authority regarding International Application No. PCT/US2010/030248, dated Nov. 26, 2010.
International Search Report regarding International Application No. PCT/US2010/030248, dated Nov. 26, 2010.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding U.S. Appl. No. 11/645,288, dated Nov. 30, 2009.
Search Report regarding European Patent Application No. 07254962.9, dated Mar. 12, 2008.
Office Action regarding Chinese Patent Application No. 200710160038.5, dated Jul. 8, 2010. Translation provided by Unitalen Attorneys At Law.
Office Action regarding Chinese Patent Application No. 200710160038.5, dated Jan. 31, 2012. Translation provided by Unitalen Attorneys At Law.
Office Action regarding Chinese Patent Application No. 201080020243.1, dated Nov. 5, 2013. Translation provided by Unitalen Attorneys At Law.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Notice of Allowance regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.

(56) References Cited

OTHER PUBLICATIONS

Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.
Non-Final Office Action for U.S. Appl. No. 18/835,048 dated Nov. 24, 2023.
Office Action regarding U.S. Appl. No. 14/294,458, dated Feb. 28, 2017.
Advisory Action regarding U.S. aPPL. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.

(56) References Cited

OTHER PUBLICATIONS

Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding U.S. Appl. No. 11/522,250, dated Aug. 1, 2007.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
Office Action regarding Chinese Patent Application No. 201010224582.3, dated Apr. 17, 2012. Translation provided by Unitalen Attorneys at Law.

* cited by examiner

COMPRESSOR AND VALVE ASSEMBLY

CROSS-REFERENCE TO RELATED APPLICATIONS

This application claims the benefit and priority of Indian Application No. 202221072622, filed Dec. 15, 2022. The entire disclosure of the above application is incorporated herein by reference.

FIELD

The present disclosure relates to a compressor and to a valve assembly of the compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure and is not a comprehensive disclosure of its full scope or all of its features.

In one form, the present disclosure provides a compressor that includes a scroll and a discharge valve assembly. The scroll includes an end plate and a spiral wrap extending from the end plate. The end plate includes a discharge passage. The discharge valve is mounted to the scroll and is configured to control fluid flow through the discharge passage. The discharge valve assembly includes a base and a valve member. The base is fixed relative to the end plate and includes a discharge opening in communication with the discharge passage. The valve member is mounted to the base. The valve member is deflectable relative to the base between a closed position in which the valve member restricts fluid flow through the discharge opening and an open position in which the valve member allows fluid flow through the discharge opening. The discharge opening includes at least one radially extending lobe.

In some configurations of the compressor of the above paragraph, the discharge valve further includes a backer fixed relative to the base. The valve member is disposed between the backer and the base. The backer defines a range of motion of the valve member In some configurations of the compressor of either of the above paragraphs, the backer is configured to allow a maximum deflection of a distal tip of a movable end of the valve member of about 6.7 millimeters to about 13.5 millimeters.

In some configurations of the compressor of any of the above paragraphs, a first side of the base includes a first seat surface and a second seat surface that is recessed from the first seat surface.

In some configurations of the compressor of any of the above paragraphs, the discharge opening extends through the first and second seat surfaces.

In some configurations of the compressor of any of the above paragraphs, a movable end of the valve member contacts the first seat surface when the valve member is in the closed position and is spaced apart from the first seat surface when the valve member is in the open position.

In some configurations of the compressor of any of the above paragraphs, the movable end of the valve member contacts the second seat surface when the valve member is in the closed position and is spaced apart from the second seat surface when the valve member is in the open position.

In some configurations of the compressor of any of the above paragraphs, the discharge opening of the base includes four radially extending lobes.

In some configurations of the compressor of any of the above paragraphs, the four radially extending lobes are evenly spaced around a circle defined by radially inner portions of a surface that defines a periphery of the discharge opening.

In some configurations of the compressor of any of the above paragraphs, the scroll is a non-orbiting scroll.

In some configurations of the compressor of any of the above paragraphs, the discharge valve assembly includes a spacer disposed between the base and the valve member.

In another form, the present disclosure provides a compressor that includes a scroll and a discharge valve assembly. The scroll includes an end plate and a spiral wrap extending from the end plate. The end plate includes a discharge passage. The discharge valve assembly is mounted to the scroll and is configured to control fluid flow through the discharge passage. The discharge valve assembly includes a base and a valve member. The base is fixed relative to the end plate and includes a discharge opening in communication with the discharge passage. The valve member is mounted to the base. The valve member is deflectable relative to the base between a closed position in which the valve member restricts fluid flow through the discharge opening and an open position in which the valve member allows fluid flow through the discharge opening. A first side of the base includes a first seat surface and a second seat surface that is recessed from the first seat surface.

In some configurations of the compressor of the above paragraph, the discharge opening extends through the first and second seat surfaces.

In some configurations of the compressor of either of the above paragraphs, a movable end of the valve member contacts the first seat surface when the valve member is in the closed position and is spaced apart from the first seat surface when the valve member is in the open position.

In some configurations of the compressor of any of the above paragraphs, the movable end of the valve member contacts the second seat surface when the valve member is in the closed position and is spaced apart from the second seat surface when the valve member is in the open position.

In some configurations of the compressor of any of the above paragraphs, the discharge valve assembly includes a backer fixed relative to the base, wherein the valve member is disposed between the backer and the base, and wherein the backer defines a range of motion of the valve member.

In some configurations of the compressor of any of the above paragraphs, the backer is configured to allow a maximum deflection of a distal tip of a movable end of the valve member of about 6.7 millimeters to about 13.5 millimeters.

In some configurations of the compressor of any of the above paragraphs, the discharge opening includes a plurality of radially extending lobes.

In some configurations of the compressor of any of the above paragraphs, radially extending lobes are evenly spaced around a circle defined by radially inner portions of a surface that defines a periphery of the discharge opening.

In some configurations of the compressor of any of the above paragraphs, the scroll is a non-orbiting scroll.

In some configurations of the compressor of any of the above paragraphs, the discharge valve assembly includes a spacer disposed between the base and the valve member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
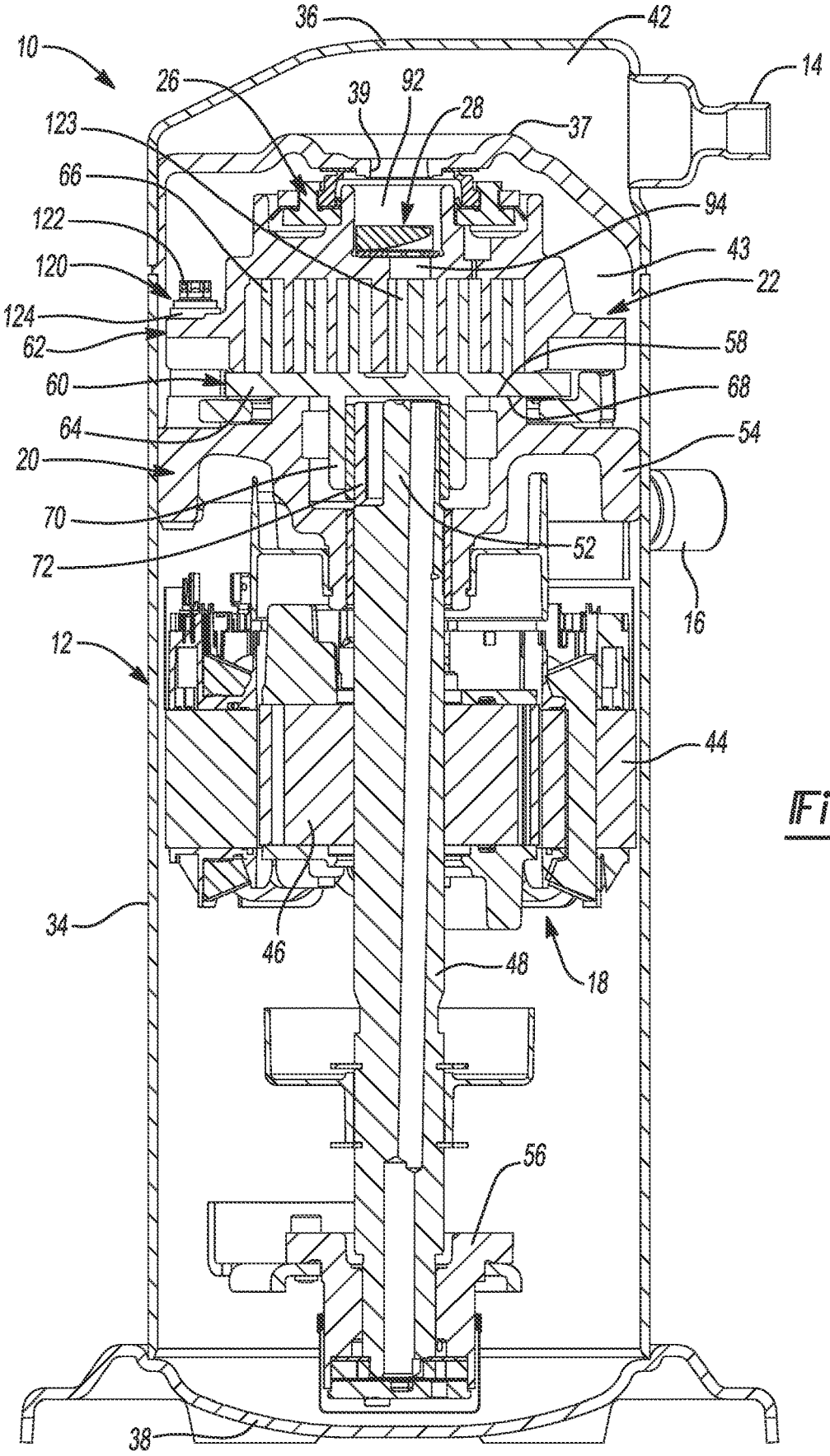
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a scroll compressor 10 is provided that may include a shell assembly 12, a discharge fitting 14, a suction inlet fitting 16, a motor assembly 18, a bearing housing assembly 20, a compression mechanism 22, a floating seal assembly 26, and a discharge valve assembly 28. As will be described in more detail below, the discharge valve assembly 28 is movable between a closed position (FIG. 2) in which the discharge valve assembly 28 restricts a flow of discharge-pressure working fluid and an open position (FIG. 3) in which the discharge valve assembly 28 allows discharge-pressure working fluid to be discharged from the compression mechanism 22.

The shell assembly 12 may house the motor assembly 18, the bearing housing assembly 20, the compression mechanism 22, the floating seal assembly 26, and the discharge valve assembly 28. The shell assembly 12 may include a generally cylindrical shell 34, an end cap 36, a transversely extending partition 37, and a base 38. The end cap 36 may be fixed to an upper end of the shell 34. The base 38 may be fixed to a lower end of shell 34. The end cap 36 and partition 37 may define a discharge chamber 42 therebetween that receives compressed working fluid from the compression mechanism 22. The partition 37 may include an aperture 39 providing communication between the compression mechanism 22 and the discharge chamber 42. The discharge chamber 42 may generally form a discharge muffler for the compressor 10.

The discharge fitting 14 may be attached to the end cap 36 and is in fluid communication with the discharge chamber 42. The suction inlet fitting 16 may be attached to the shell 34 and may be in fluid communication with a suction chamber 43. While the compressor 10 is shown in FIG. 1 as including the discharge chamber 42 and suction chamber 43, it will be appreciated that the present disclosure is not limited to compressors having discharge chambers and/or suction chambers and applies equally to direct discharge configurations and/or direct or directed suction configurations.

The motor assembly 18 may include a motor stator 44, a rotor 46, and a drive shaft 48. The stator 44 may be press fit into the shell 34. The drive shaft 48 may be rotatably driven by the rotor 46 and supported by the bearing housing assembly 20. The drive shaft 48 may include an eccentric crank pin 52 having a flat thereon for driving engagement with the compression mechanism 22. The rotor 46 may be press fit on the drive shaft 48. The bearing housing assembly 20 may include a main bearing housing 54 and a lower bearing housing 56 fixed within the shell 34. The bearing housings 54, 56 may be fixed relative to the shell assembly 12 and may house bearings that rotatably support the drive shaft 48. The main bearing housing 54 may include an annular flat thrust bearing surface 58 that supports the compression mechanism 22 thereon.

The compression mechanism 22 may be driven by the motor assembly 18 and may generally include an orbiting scroll 60 and a non-orbiting scroll 62. The orbiting scroll 60 may include an end plate 64 having a spiral vane or wrap 66 on the upper surface thereof and an annular flat thrust surface 68 on the lower surface. The thrust surface 68 may interface with an annular flat thrust bearing surface 58 on the main bearing housing 54. A cylindrical hub 70 may project downwardly from the thrust surface 68 and may have a drive bushing 72 disposed therein. The drive bushing 72 may include an inner bore in which the crank pin 52 is drivingly disposed. The crank pin 52 may drivingly engage a flat surface in a portion of the inner bore of the drive bushing 72 to provide a radially compliant driving arrangement.

Figure 2:
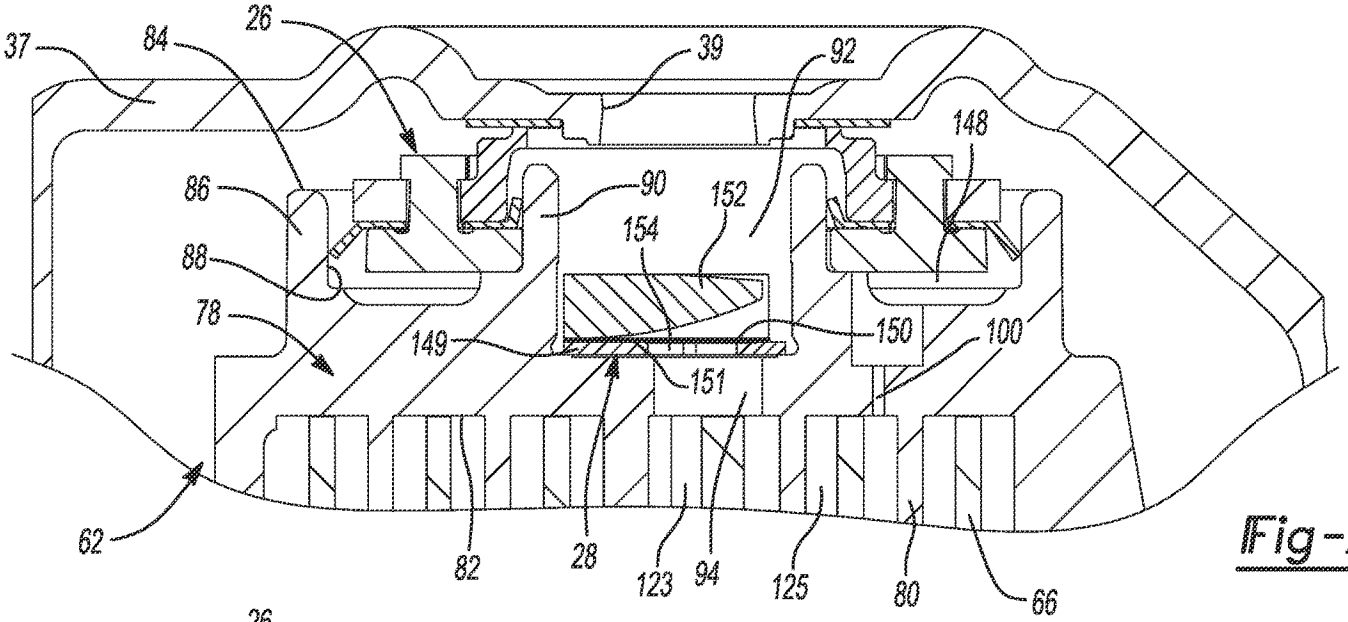
FIG. 2 is a partial cross-sectional view of a compression mechanism of the compressor of FIG. 1 with a discharge valve assembly in a closed position.
Figure 3:
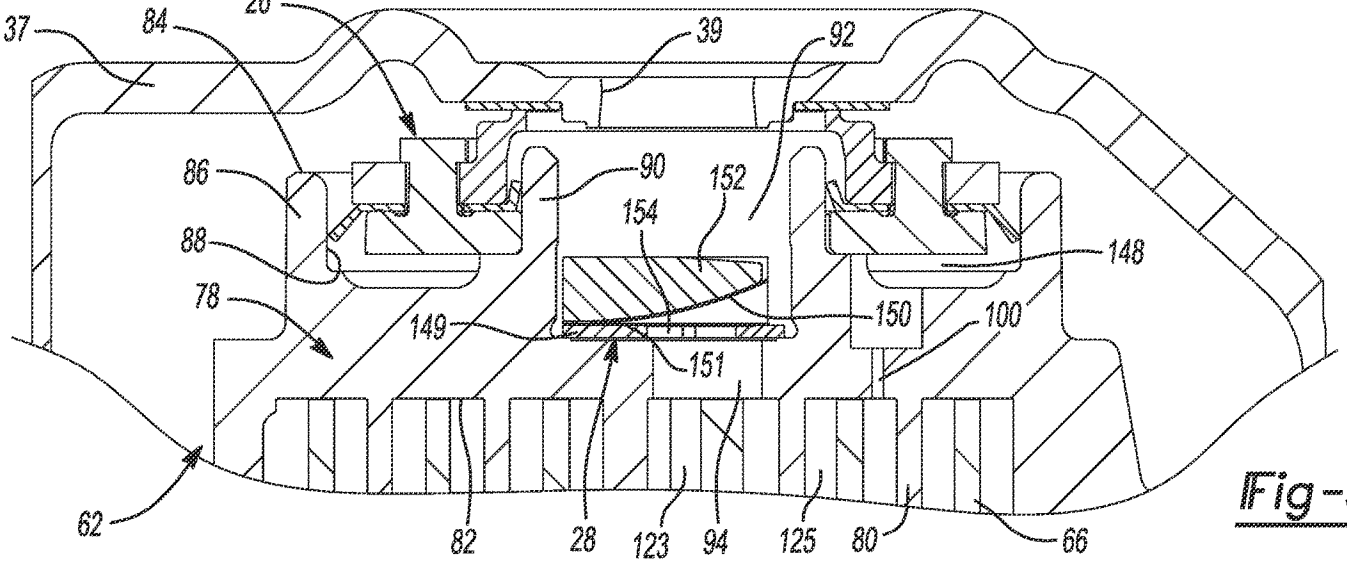
FIG. 3 is another partial cross-sectional view of the compression mechanism with the discharge valve assembly in an open position.
Figure 4:
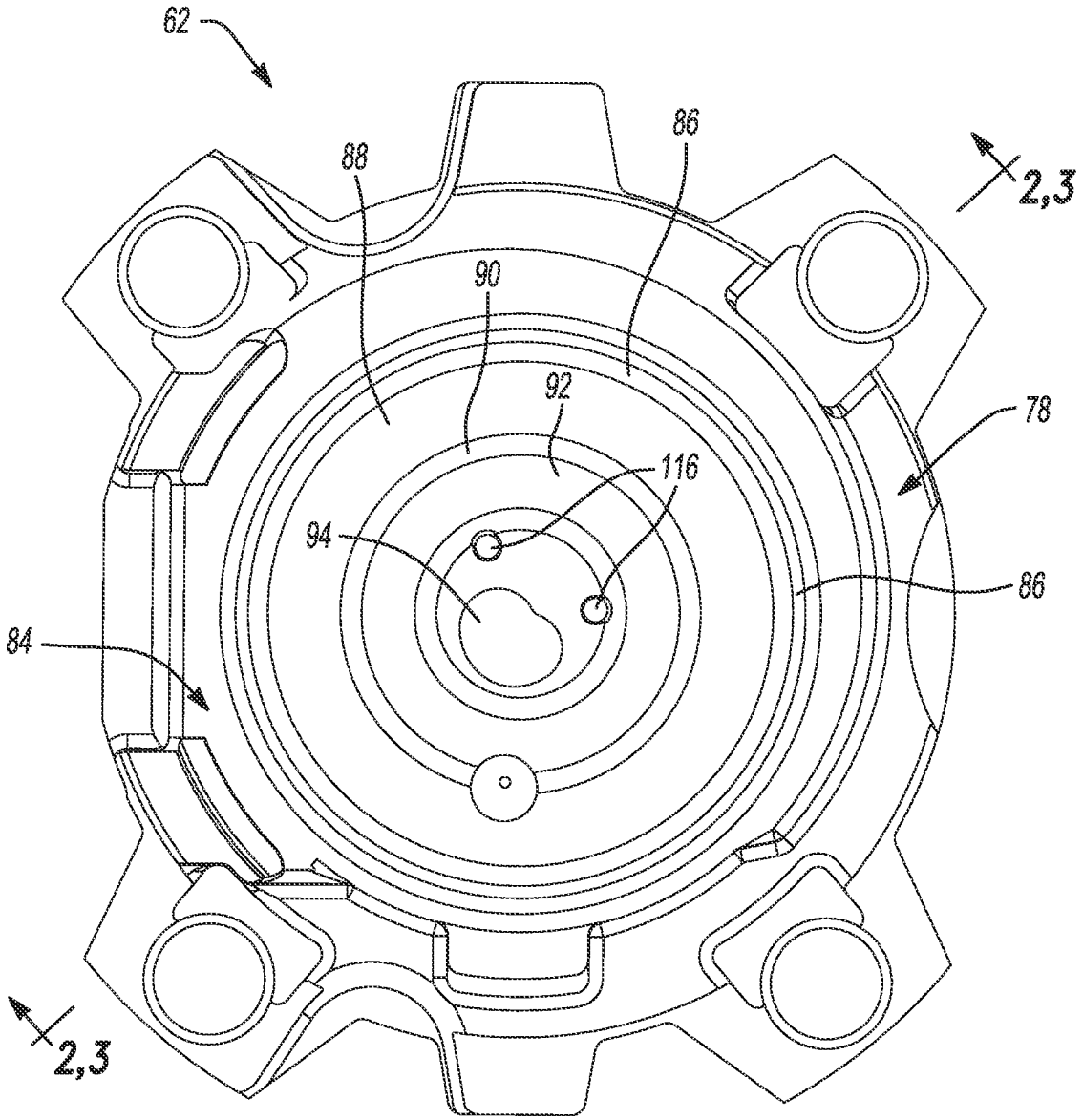
FIG. 4 is a plan view of a non-orbiting scroll of the compressor of FIG. 1.

As shown in FIGS. 2-4, the non-orbiting scroll 62 may include an end plate 78 and a spiral wrap 80 extending from a first side 82 of the end plate 78. A second side 84 of the end plate 78 may include a first annular wall 86 and a second annular wall 90. The first and second annular walls 86, 90 cooperate to define an annular recess 88. The second annular wall 90 may be disposed radially inward relative to the first annular wall 86 and may define a discharge recess 92. The annular recess 88 may encircle the discharge recess 92 and may be substantially concentric therewith. As shown in FIGS. 2 and 3, a discharge passage 94 may extend through the end plate 78 from the first side 82 to the discharge recess 92.

As shown in FIG. 4, the end plate 78 may include a pair of bores 116. In some embodiments, the bores 116 may be blind, non-threaded holes formed in the discharge recess 92 that extend only partially through the end plate 78. In some embodiments, the bores 116 may be threaded holes formed in the discharge recess 92 that extend only partially through the end plate 78.

Returning to FIG. 1, the non-orbiting scroll 62 may be rotationally secured to the main bearing housing 54 by a retaining assembly 120. The retaining assembly 120 allows for limited axial displacement of the non-orbiting scroll 62 relative to the orbiting scroll 60 and the main bearing housing 54 based on pressurized gas from biasing passage 100. The retaining assembly 120 may include a plurality of fasteners 122 and bushings 124 extending through apertures in the non-orbiting scroll 62. The fasteners 122 may fixedly engage the main bearing housing 54. The non-orbiting scroll 62 may be axially moveable along the bushings 124 relative to the fasteners 122.

The spiral wrap 80 of the non-orbiting scroll 62 may meshingly engage the spiral wrap 66 of the orbiting scroll 60, thereby creating a series of pockets therebetween. The fluid pockets defined by the spiral wraps 66, 80 may decrease in volume as they move from a radially outer position (at a suction pressure) to a radially intermediate position (at an intermediate pressure) to a radially inner position (at a discharge pressure) throughout a compression cycle of the compression mechanism 22. The discharge passage 94 may be in fluid communication with the fluid pocket 123 at the radially inner position. When the discharge valve assembly 28 is in the open position (FIG. 2), working fluid from the fluid pocket 123 at the radially inner position (discharge-pressure working fluid) may flow through the discharge passage 94, through the discharge valve assembly 28, through the discharge recess 92 and into the discharge chamber 42. The biasing passage 100 in the end plate 78 may be in fluid communication with the fluid pocket 125 at the radially intermediate position.

The floating seal assembly 26 may be disposed within the annular recess 88 and may sealingly engage the first annular wall 86, second annular wall 90, and the partition 37 to form an annular biasing chamber 148. The annular biasing chamber 148 is isolated from the suction and discharge chambers 43, 42 and is in communication with the fluid pocket 125 at the radially intermediate position via the biasing passage 100. During operation of the compressor 10, the biasing chamber 148 may be filled with intermediate-pressure working fluid from the fluid pocket 125 at the radially intermediate position, which biases the non-orbiting scroll 62 in an axial direction toward the orbiting scroll 60.

Figure 5:
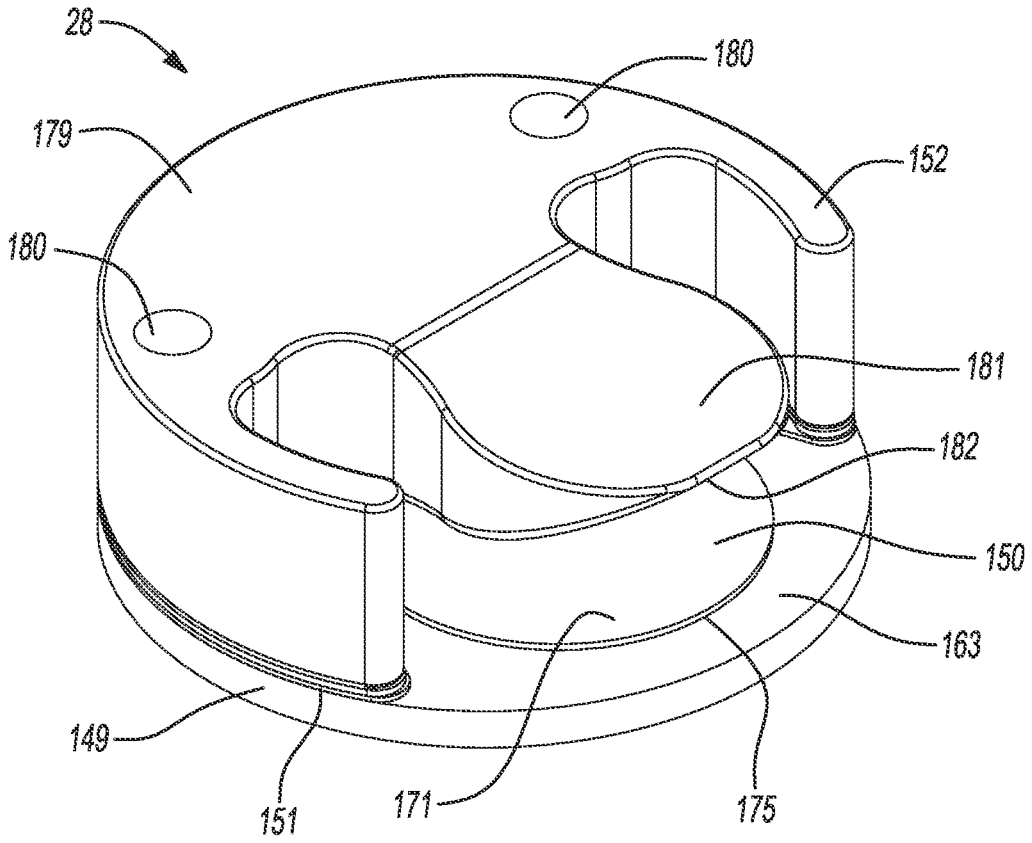
FIG. 5 is perspective view of the discharge valve assembly according to the principles of the present disclosure.
Figure 6:
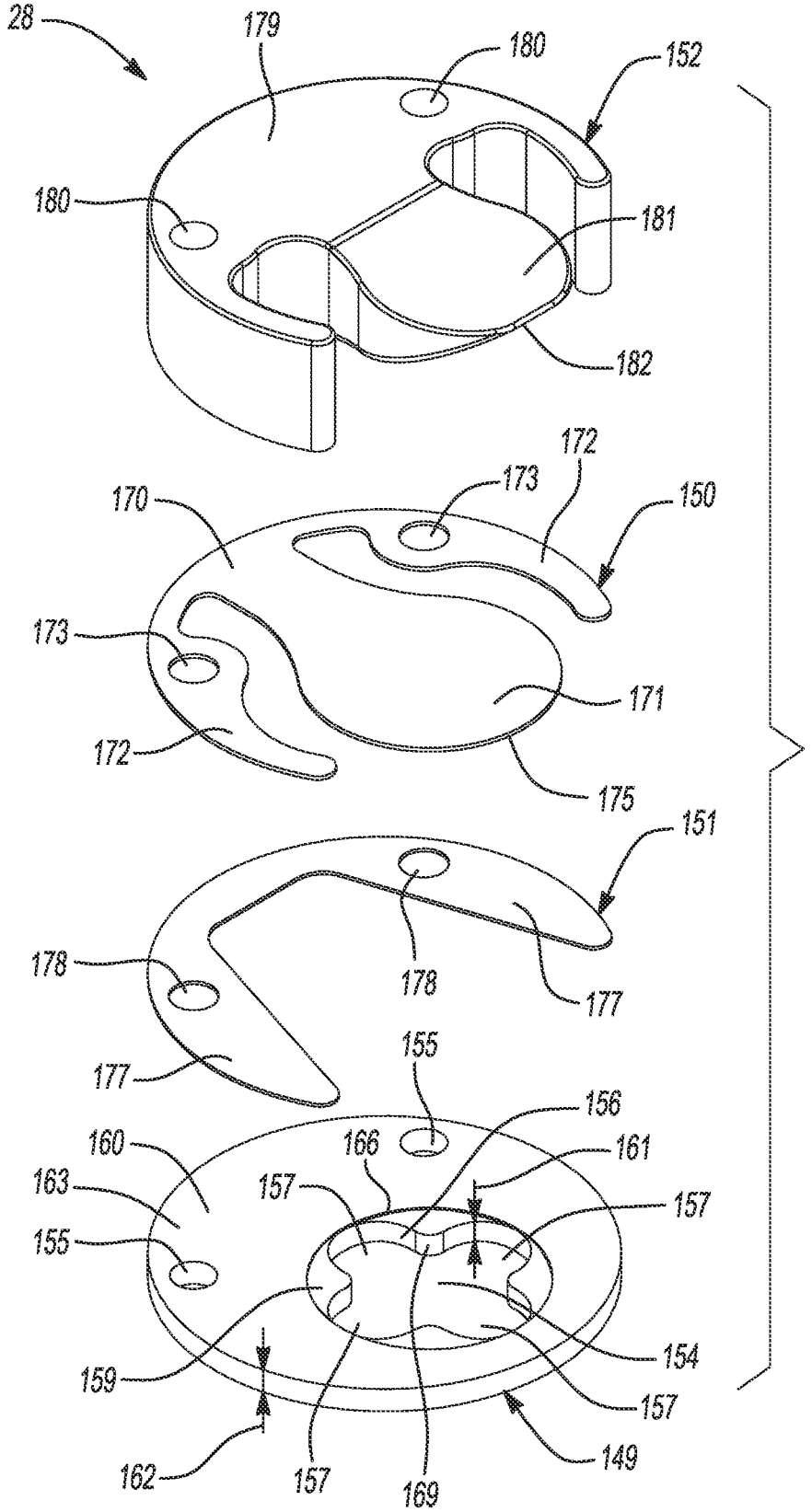
FIG. 6 is an exploded perspective view of the discharge valve assembly of FIG. 5.

The discharge valve assembly 28 may be received in the discharge recess 92 of the non-orbiting scroll 62 and may control fluid flow through the discharge passage 94. As shown in FIGS. 5 and 6, the discharge valve assembly 28 may include a base 149, a reed valve member 150, a spacer 151, and a backer 152.

Figure 7:
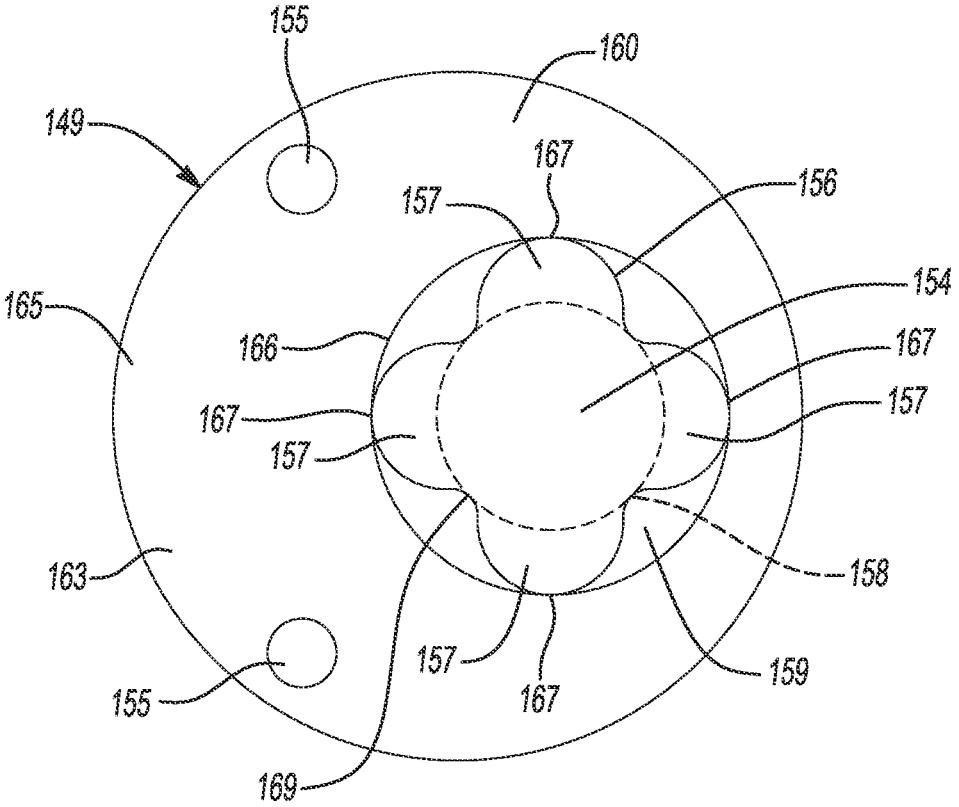
FIG. 7 is a plan view of a base of the discharge valve assembly of FIG. 5.

As shown in FIGS. 5-7, the base 149 may be a disk-shaped member having a discharge opening 154 and a pair of bores 155 extending therethrough. The bores 155 may be coaxially aligned with the bores 116 of the end plate 78. The base 149 may be seated against the end plate 78 such that the discharge opening 154 is generally aligned with the discharge passage 94, as shown in FIGS. 2 and 3.

A surface 156 defining a periphery of the discharge opening 154 may include one or more extensions 157 (or lobes) extending radially outward from radially inner portions 169 of the surface 156 that define an inner circle 158 (shown in dashed lines in FIG. 7). The one or more extensions 157 may be generally curved such that the surface 156 of the discharge opening 154 is curved. The extensions 157 may extend radially outward from the inner circle 158 to form a generally flower shape of the discharge opening 154. In some embodiments, the extensions 157 are evenly spaced around the discharge opening 154. In other embodiments, one or pairs of adjacent extensions 157 may be spaced further apart from each other than one or more other pairs of adjacent extensions 157. In some embodiments, such as the embodiment shown in FIGS. 5-7, the discharge opening 154 includes four extensions 157. However, in some embodiments there may be as few as one extension or as many as six extensions. In some embodiments, one or more of the extensions 157 may have a different size and/or shape than one or more other extensions 157. The discharge opening 154 having one or more of the extensions 157 may improve the flow of compressed working fluid from the discharge passage 94 to the discharge chamber 42. In some embodiments, the positioning of the extensions 157 around the inner circle 158 may be different from the positioning shown in the figures (e.g., to optimize load distribution, for example).

The base 149 may include a first seat surface (or upper seat surface) 163 and a second seat surface (or recessed seat surface) 159 on a first side 160 of the base 149. The first seat surface 163 may surround the second seat surface 159. The spacer 151 may be mounted to the first seat surface 163. The first side 160 of the base 149 may be the side adjacent to the reed valve member 150 when the discharge valve assembly 28 is assembled. The second seat surface 159 may be recessed from the first seat surface 163 of the base 149. In other words, the second seat surface 159 may be a counterbore in the first side 160 of the base 149 surrounding the discharge opening 154. A thickness 161 of the base 149 at the second seat surface 159 may be less than a thickness 162 of the base 149 at the first seat surface 163 surrounding the second seat surface 159. In some configurations, the thickness 161 at the second seat surface 159 may be between 0.02 millimeters and 0.1 millimeters thinner than the thickness 162 at the first seat surface 163. The second seat surface 159 may have a circular outer periphery 166. The second seat surface 159 may extend between the extensions 157 of the discharge opening 154. In some embodiments, the second seat surface 159 may surround the entirety of the discharge opening 154. In other embodiments, the outer periphery 166 of the second seat surface 159 may be at least partially defined by radially outer portions 167 of the surface 156 of the extensions 157 of the discharge opening 154.

In some configurations, the base 149 could include another recessed surface (similar to the second seat surface 159) on the side of the base 149 opposite the side 160. Such a recessed surface may at least partially surround the opening 154 in the same or similar manner as the second seat surface 159.

As shown in FIGS. 5 and 6, the reed valve member 150 may be a thin, resiliently flexible member having a fixed end 170 and a movable end 171. A pair of arms 172 may extend from the fixed end 170 and may each include a bore 173. The reed valve member 150 may be seated against the spacer 151, which in turn, may be seated against the base 149 such that the bores 173 are coaxially aligned with the bores 155 in the base 149. The movable end 171 of the reed valve member 150 is deflectable relative to the fixed end 170 between the closed position (FIG. 2) in which the movable end 171 sealingly seats against the base 149 to restrict or prevent fluid flow through the discharge opening 154 (thereby preventing fluid flow through the discharge passage 94) and the open position (FIG. 3) in which the movable end 171 is deflected upward away from the base 149 and toward the backer 152 to allow fluid flow through the discharge passage 94 and the discharge opening 154.

The reed valve member 150 may be moved to the open position due to a pressure differential on opposing sides of the reed valve member 150, such as when the pressure within the discharge passage 94 (and fluid pocket 123) exceeds the pressure within the discharge chamber 42. An amount of deflection of the movable end 171 of the reed valve member 150 may vary based on a distance from the fixed end 170. For example, the amount of deflection may be larger in portions of the movable end 171 of the reed valve member 150 which are farther away from the fixed end 170. The fixed end 170 may be fixed by the backer 152 being coupled to the base 149 (i.e., the fixed end 170 is sandwiched between the backer 152 and the base 149). A maximum amount of deflection of the movable end 171 may occur at a portion 175 of the movable end 171 of the reed valve member 150 furthest from the fixed end 170. In some embodiments, the portion 175 of the movable end 171 of the reed valve member 150 furthest from the fixed end 170 may be about 30 millimeters from the fixed end 170.

The movable end 171 of the reed valve member 150 may move to the closed position by moving in a downward direction toward the first and second seat surfaces 163, 159 due to the pressure in the discharge chamber 42 increasing relative to the pressure within the discharge passage 94 and/or due to pressure within the discharge passage 94 decreasing relative to the pressure in the discharge chamber 42, which allows the spring force of the resiliently flexible reed valve member 150 to force the movable end 171 toward the closed position. In the closed position, the reed valve member 150 restricts or prevents fluid flow between the discharge chamber 42 and the discharge passage 94.

Figure 8:
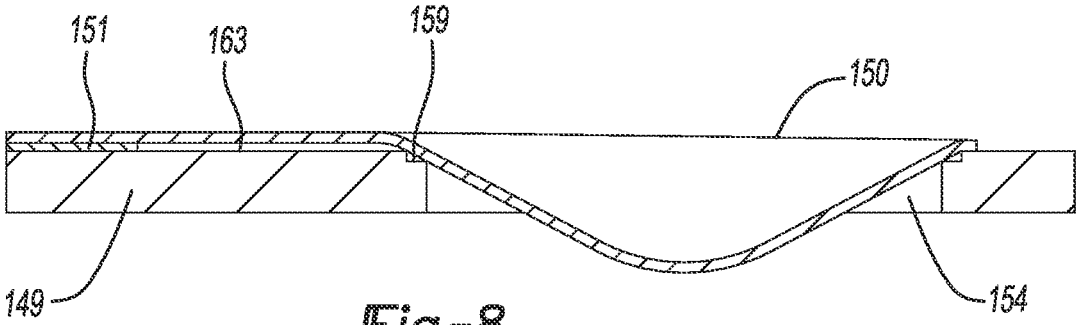
FIG. 8 is a cross-sectional view of the base, a spacer, and a reed valve member of the discharge valve assembly in a closed position.
Figure 9:
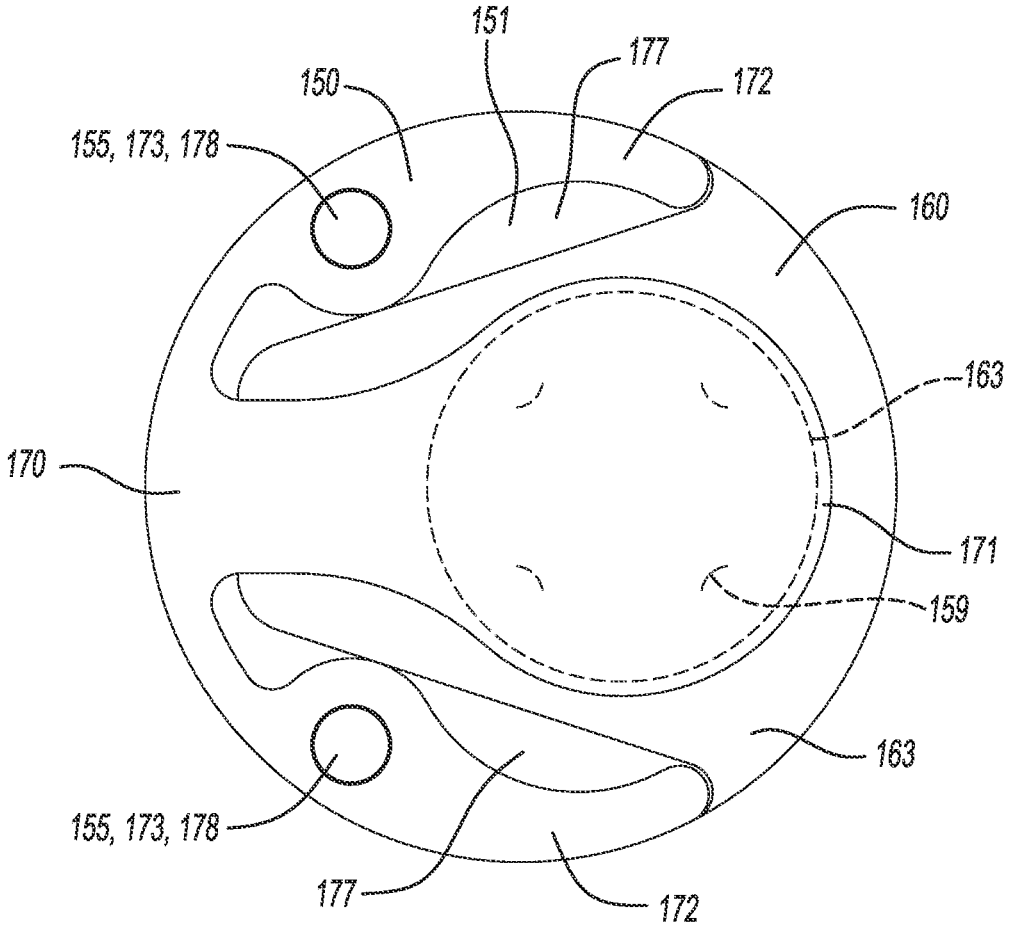
FIG. 9 is a plan view of the base, the spacer, and the reed valve member of the discharge valve assembly in a closed position.

As shown in FIGS. 8 and 9, the movable end 171 of the reed valve member 150 may seal against the first seat surface 163 of the base 149 adjacent to the outer periphery 166 of the second seat surface 159 when in the closed position. Under some operating conditions, the movable end 171 of the reed valve member 150 may also seal against the second seat surface 159 as the movable end 171 deforms into the discharge opening 154 due to the pressure differential between the discharge chamber 42 and the discharge passage 94. Dashed lines in FIG. 9 show locations on which the reed valve member 150 may seal against the first seat surface 163 and the second seat surface 159, respectively, when in the closed position. The movable end 171 of the reed valve member 150 sealing against the first seat surface 163 and against the second seat surface 159 may provide an improved seal when the movable end 171 of the reed valve member 150 is in the closed position. This improved seal may reduce or eliminate leakage of working fluid through the discharge valve assembly 28 when the movable end 171 of the reed valve member 150 is in the closed position, thus improving efficiency of the discharge valve assembly 28 and the compressor 10.

The combination of the shape of the discharge opening 154 and the recessed second seat surface 159 may result in significant performance improvements relative to prior-art discharge valves (e.g., better sealing in the closed position and better fluid flow in the open position). For example, the extensions 157 increase the flow area (or port area) of the discharge opening 154 without increasing an unsupported span distance of the reed valve member 150 (i.e., the diameter of the inner circle 158 or a maximum distance over which the reed valve member 150 spans the discharge opening 154 between points of contact between the reed valve member 150 and the second seat surface 159). In the particular example shown in the figures, the flow area of the discharge opening 154 is approximately 106 $mm^2$ (106 square millimeters) and the unsupported span distance is about 8.58 mm. By contrast, a similarly sized discharge opening (i.e., with unsupported span distance of 8.58 mm) that does not have the extensions 157 would have a flow area of approximately 57.8 $mm^2$ (57.8 square millimeters). Therefore, the discharge opening 154 with the extensions 157 significantly increases the flow area (which improves fluid flow when the reed valve member 150 is in the open position) without increasing the unsupported span distance (which allows for better sealing and reduces stresses when the reed valve member 150 is in the closed position). Such performance improvements increase the overall efficiency of the compressor 10, which reduces energy consumption and improves operation of the climate-control system in which the compressor 10 is installed.

Returning to FIG. 6, the spacer 151 may include a pair of arms 177 shaped to correspond to the arms 172 of the reed valve member 150. Each of the arms 177 may include a bore 178 coaxially aligned with corresponding ones of the bores 173, 155. The spacer 151 may be disposed between the base 149 and the reed valve member 150 to create a space between the movable end 171 and the discharge opening 154. The movable end 171 of the reed valve member 151 may move into this space when entering the closed position to seal the discharge opening 154.

The backer 152 may include a body 179 having a pair of bores 180 extending therethrough. The body 179 may include a lobe portion 181 shaped to correspond to the shape of the movable end 171 of the reed valve member 150. The lobe portion 181 may include an inclined surface 182 that faces the reed valve member 150 and forms a valve stop that defines a maximum amount of deflection of the movable end 171 of the reed valve member 150. The inclined surface 182 may be shaped to allow the reed valve member 150 to open to a greater extent than traditional discharge valve assemblies while limiting stress in the reed valve member 151. Such an expanded opening may allow for increased flow of the working fluid through the discharge passage 94 and through the discharge valve assembly 28. Such increased fluid flow improves the efficiency of the compressor 10, which reduces energy consumption and improves operation of the climate-control system in which the compressor 10 is installed.

Figure 10:
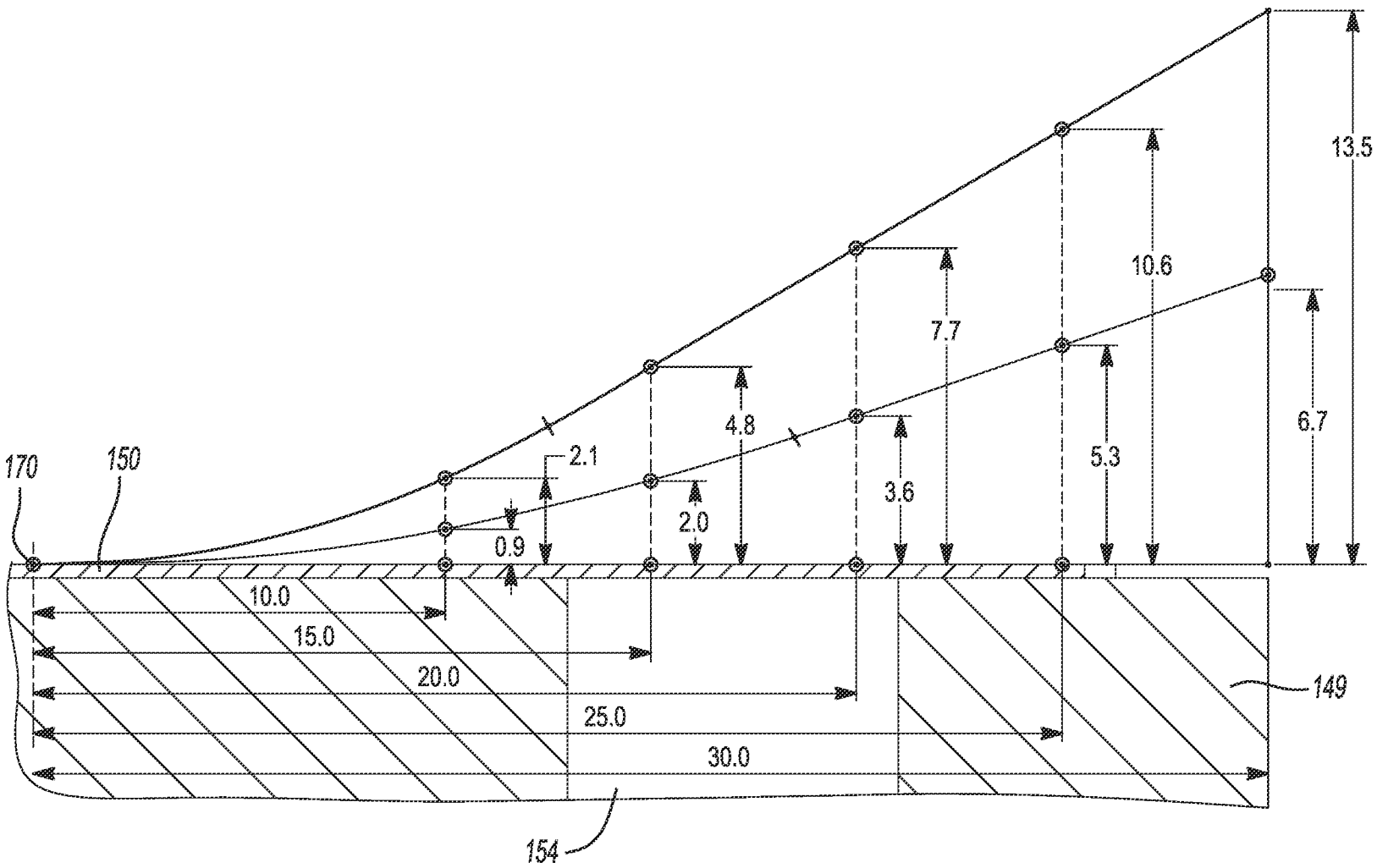
FIG. 10 is a graph of the opening distances of an exemplary reed valve member.

FIG. 10 provides a graph showing ranges to which the movable end 171 of the reed valve member 150 may move between the closed position and the open position. These ranges may be determined by the shape of the lobe portion 181 of the backer 152. In some embodiments, the inclined surface 182 of the lobe portion 181 may be configured to allow the movable end 171 of the reed valve member 150 to deflect to a maximum deflection between 6.7 millimeters and 13.5 millimeters (at a distal tip of the movable end 171). In some embodiments, the inclined surface 182 of the lobe portion 181 may be configured to allow a point on the reed valve member 150 which is about 25 millimeters from the fixed end 170 to deflect between about 5.3 millimeters and about 10.6 millimeters from the closed position.

In some embodiments, the inclined surface 182 of the lobe portion 181 may be configured to allow a point on the reed valve member 150 which is about 20 millimeters from the pivot point 174 to deflect between about 3.6 millimeters and about 7.7 millimeters from the closed position. In some embodiments, the inclined surface 182 of the lobe portion 181 may be configured to allow a point on the reed valve member 150 which is about 15 millimeters from the pivot point 174 to deflect between about 2 millimeters and about 4.8 millimeters from the closed position. In some embodiments, the inclined surface 182 of the lobe portion 181 may be configured to allow a point on the reed valve member 150 which is about 10 millimeters from the pivot point 174 to deflect between about 0.9 millimeters and about 2.1 millimeters from the closed position.

Fasteners may pass through the bores 116, 155, 173, 178, 180 to secure the discharge valve assembly 28 to the end plate 78. In some embodiments, the fasteners may be threaded. In some embodiments, the fasteners may be spiral pins having resiliently contractable diameters to facilitate insertion into the bores 116, 155, 173, 178, 180. In some embodiments, pins may be press fit in the non-threaded bores 116, 155, 173, 178, 180 to secure the discharge valve assembly 28 to the end plate 78.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a scroll including an end plate and a spiral wrap extending from the end plate, the end plate including a discharge passage; and a discharge valve assembly mounted to the scroll and configured to control fluid flow through the discharge passage, the discharge valve assembly including a base and a valve member, wherein the base is fixed relative to the end plate and includes a discharge opening in communication with the discharge passage, wherein the valve member is mounted to the base, wherein the valve member is deflectable relative to the base between a closed position in which the valve member restricts fluid flow through the discharge opening and an open position in which the valve member allows fluid flow through the discharge opening, and wherein the discharge opening includes at least one radially extending lobe.

2. The compressor of claim 1, wherein the discharge valve assembly includes a backer fixed relative to the base, wherein the valve member is disposed between the backer and the base, and wherein the backer defines a range of motion of the valve member.

3. The compressor of claim 2, wherein the backer is configured to allow a maximum deflection of a distal tip of a movable end of the valve member of about 6.7 millimeters to about 13.5 millimeters.

4. The compressor of claim 1, wherein the discharge opening of the base includes four radially extending lobes.

5. The compressor of claim 4, wherein the four radially extending lobes are evenly spaced around a circle defined by radially inner portions of a surface that defines a periphery of the discharge opening.

6. The compressor of claim 1, wherein the scroll is a non-orbiting scroll.

7. The compressor of claim 1, wherein the discharge valve assembly includes a spacer disposed between the base and the valve member.

8. The compressor of claim 1, wherein a first side of the base includes a first seat surface and a second seat surface that is recessed from the first seat surface.

9. The compressor of claim 8, wherein the discharge opening extends through the first and second seat surfaces.

10. The compressor of claim 9, wherein a movable end of the valve member contacts the first seat surface when the valve member is in the closed position and is spaced apart from the first seat surface when the valve member is in the open position.

11. The compressor of claim 10, wherein the movable end of the valve member contacts the second seat surface when the valve member is in the closed position and is spaced apart from the second seat surface when the valve member is in the open position.

12. A compressor comprising:

a scroll including an end plate and a spiral wrap extending from the end plate, the end plate including a discharge passage; and a discharge valve assembly mounted to the scroll and configured to control fluid flow through the discharge passage, the discharge valve assembly including a base and a valve member, wherein the base is fixed relative to the end plate and includes a discharge opening in communication with the discharge passage, wherein the valve member is mounted to the base, wherein the valve member is deflectable relative to the base between a closed position in which the valve member restricts fluid flow through the discharge opening and an open position in which the valve member allows fluid flow through the discharge opening, wherein a first side of the base includes a first seat surface and a second seat surface that is recessed from the first seat surface, wherein the discharge opening extends through the first and second seat surfaces, wherein a movable end of the valve member contacts the first seat surface when the valve member is in the closed position and is spaced apart from the first seat surface when the valve member is in the open position, and wherein the movable end of the valve member contacts the second seat surface when the valve member is in the closed position and is spaced apart from the second seat surface when the valve member is in the open position.

13. The compressor of claim 12, wherein the discharge valve assembly includes a backer fixed relative to the base, wherein the valve member is disposed between the backer and the base, and wherein the backer defines a range of motion of the valve member.

14. The compressor of claim 13, wherein the backer is configured to allow a maximum deflection of a distal tip of a movable end of the valve member of about 6.7 millimeters to about 13.5 millimeters.

15. The compressor of claim 12, wherein the discharge opening includes a plurality of radially extending lobes.

16. The compressor of claim 15, radially extending lobes are evenly spaced around a circle defined by radially inner portions of a surface that defines a periphery of the discharge opening.

17. The compressor of claim 12, wherein the scroll is a non-orbiting scroll.

* * * * *